US007936131B2

(12) United States Patent
Yeh

(10) Patent No.: US 7,936,131 B2
(45) Date of Patent: May 3, 2011

(54) AC POWER FEEDBACK CONTROL DEVICE

(75) Inventor: Chen-Kuang Yeh, Hsinchu (TW)

(73) Assignee: Holtek Semiconductor, Inc., Hsinchu (TW)

( * ) Notice: Subject to any disclaimer, the term of this patent is extended or adjusted under 35 U.S.C. 154(b) by 432 days.

(21) Appl. No.: 12/234,974

(22) Filed: Sep. 22, 2008

(65) Prior Publication Data

US 2009/0236995 A1 Sep. 24, 2009

(30) Foreign Application Priority Data

Mar. 18, 2008 (TW) ..... 97109554 A

(51) Int. Cl.
*H05B 41/16* (2006.01)

(52) U.S. Cl. ..... 315/246; 315/299

(58) Field of Classification Search ..... 315/246, 315/291, 299, 307, 308; 327/518
See application file for complete search history.

(56) References Cited

U.S. PATENT DOCUMENTS 6,531,825 B1 * 3/2003 Iacob ..... 315/105
7,288,903 B2 * 10/2007 Jang et al. ..... 315/307
7,446,750 B2 * 11/2008 Moon ..... 345/102

* cited by examiner

*Primary Examiner* — Thuy Vinh Tran
(74) *Attorney, Agent, or Firm* — Volpe and Koenig, PC

(57) ABSTRACT

An AC power feedback control device for a vacuum fluorescent display is provided. In the AC power feedback control device, the Class-D drivers are driven by the PWM controller so as to generate a sine wave voltage. After being filtered by the LPFs, the sine wave voltage is ready for filaments. The output voltage outputted by the filaments is detected by simple feedback elements so as to control and modulate the duty cycle of the PWM controller.

17 Claims, 5 Drawing Sheets

AC POWER FEEDBACK CONTROL DEVICE

FIELD OF THE INVENTION

The present invention relates to an AC power feedback control device, and more particularly to an AC power feedback control device for a vacuum fluorescent display (VFD).

BACKGROUND OF THE INVENTION

Vacuum fluorescent display (VFD) is commonly utilized in the application of a small display to provide a better contrast of brightness. VFD has the advantages of better brightness, wider visual angle, larger operating temperature range and lower production cost.

In VFD, the driving method for the filaments depends on the type of the filaments. Generally, there are two kinds of the driving methods for the filaments. One is the AC power driving method and the other is the dc power driving method.

For generating an AC power to drive the filaments of a VFD operated in a dc power supply, an AC sine wave signal is generated by using a transformer based on the LC oscillation effect resulted from an inductor and a capacitor. The frequency can be adjusted by changing the inductance of the inductor and the capacitance of the capacitor, the amplitude can be adjusted by changing the turn ratio of the coils of the transformer, and the phase can be adjusted by changing the central tap of the transformer and incorporating a Zener diode.

Although the circuit topology of the above traditional AC power control device is simple, it lacks of a feedback control loop. When the input voltage is changed, the output voltage will be influenced undesirably.

SUMMARY OF THE INVENTION

It is therefore an object of the present invention to provide an AC power feedback control device for a vacuum fluorescent display. In the AC power feedback control device, the output voltage outputted by the filaments is detected and stabilized by simple feedback circuits controlling and modulating the duty cycle of the AC sine wave signal inputted to the filaments.

According to the foregoing object of the present invention, an AC power feedback control device is provided. The AC power feedback control device includes a controller generating a control signal; a filtering apparatus filtering the control signal to generate a sine wave signal with a first peak; a filament driven by the sine wave signal; a first peak detector detecting a value of the first peak of the sine wave signal; and a first comparator and a second comparator comparing the value of the first peak with a first and a second predetermined voltage values respectively so as to modulate the control signal.

Preferably, the filtering apparatus comprises at least a class-D driver and at least a low-pass filter.

Preferably, the filament is for lighting a vacuum fluorescent display.

Preferably, the first peak is a maximum peak of the sine wave signal.

Preferably, the AC power feedback control device further includes a second peak detector detecting a value of a second peak of the sine wave signal; and a third comparator and a fourth comparator comparing the value of the second peak with a third and a fourth predetermined voltage values respectively so as to modulate the control signal.

Preferably, the second peak is a minimum peak of the sine wave signal.

The foregoing and other features and advantages of the present invention will be more clearly understood through the following descriptions with reference to the drawings, wherein:

DETAILED DESCRIPTION OF THE PREFERRED EMBODIMENT

The present invention will now be described more specifically with reference to the following embodiments. It is to be noted that the following descriptions of preferred embodiments of this invention are presented herein for the purposes of illustration and description only; it is not intended to be exhaustive or to be limited to the precise form disclosed.

Figure 1:
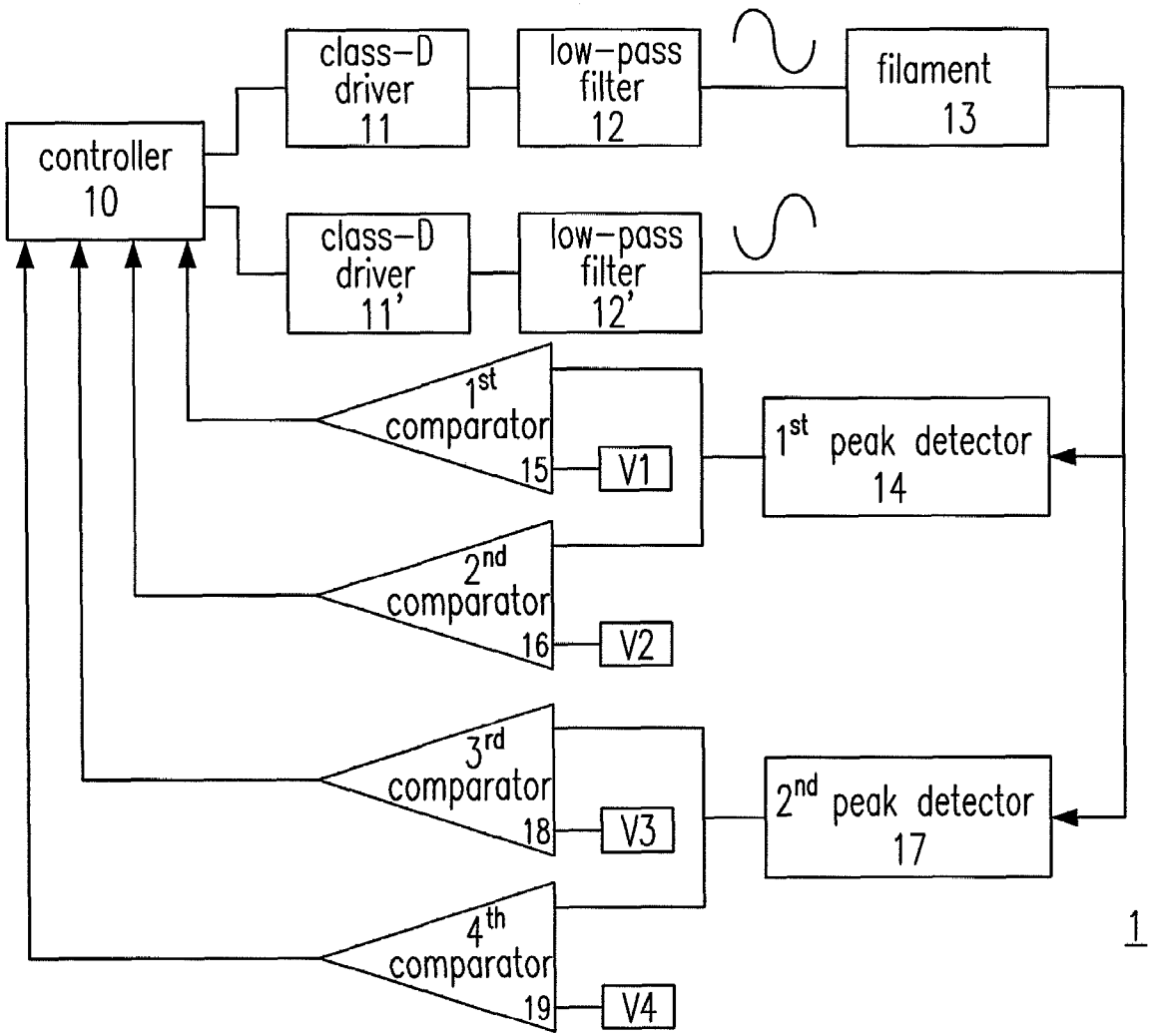
FIG. 1 is a block diagram showing an AC power feedback control device according to the present invention.

Please refer to FIG. 1, which is a block diagram showing an AC power feedback control device according to the present invention. In FIG. 1, the AC power feedback control device 1 includes a controller 10, two class-D drivers 11 and 11', two low-pass filters 12 and 12', a filament 13, a first peak detector 14, a first and a second comparators 15 and 16, a second peak detector 17, and a third and a fourth comparators 18 and 19.

A control signal generated from the controller 10 is inputted to the two class-D drivers 11 and 11'. Two high-frequency driving signals are then generated from the class-D drivers 11 and 11'. The low-pass filters 12 and 12' filters off the high-frequency signals. The Two sine wave signals are tehn generated to drive the filament 13. For stabilizing the output voltage, the first peak detector 14 and the second peak detector 17 are incorporated here to detect the peaks of the sine waves which are feedbacked. That is to say, the first peak detector 14 is used to detect a value of the maximum peak of each the sine waves which are feedbacked and the second peak detector 17 is used to detect a value of the minimum peak of each the sine waves which are feedbacked.

In the feedback circuit constituted by the element blocks 14~19, one of the input terminals of the first comparator 15 is to receive an upper limit V1 for the maximum peak of the sine wave which is feedbacked, one of the input terminals of the second comparator 16 is to receive an lower limit V2 for the maximum peak of the sine wave which is feedbacked, one of the input terminals of the third comparator 18 is to receive an upper limit V3 for the minimum peak of the sine wave which is feedbacked, and one of the input terminals of the fourth comparator 19 is to receive an lower limit V4 for the minimum peak of the sine wave which is feedbacked. The value of the maximum peak of the sine wave detected by the first peak detector 14 is compared with the upper limit V1 and the lower limit V2 and the value of the minimum peak of the sine wave detected by the second peak detector 17 is compared with the upper limit V3 and the lower limit V4, four feedback signals are then generated. Sampling values of the sine waves can be adjusted based on the four feedback signals to change the duty cycle of the controller 10, so as to stabilize the output voltage.

The preferable schemes of all the element blocks of the AC power feedback control device are described as follows.

The controller 10 of the AC power feedback control device 1 can be a pulse-width modulation (PWM) controller or a pulse-frequency modulation (PFM) controller. The filament 13 is one for lighting a vacuum fluorescent display (VFD).

Figure 2:
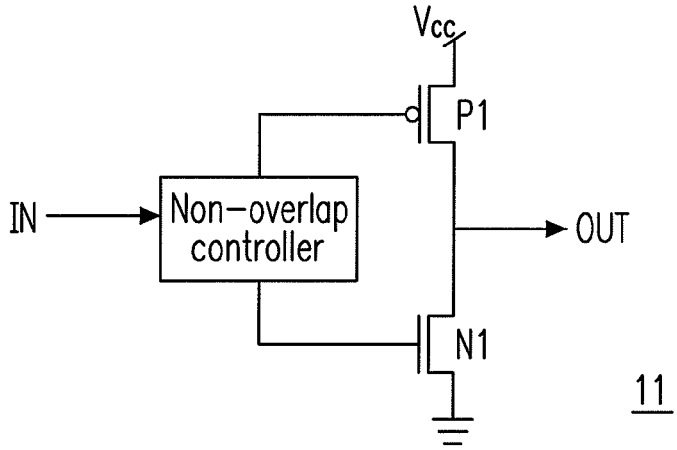
FIG. 2 is a circuit diagram showing the class-D driver of FIG. 1 according to the present invention.

Please refer to FIG. 2, which is a circuit diagram showing the class-D driver of FIG. 1 according to the present invention. The class-D driver 11 or 11' is a half-bridge converter constituted by a non-overlap controller, a PMOS transistor P1 and a NMOS transistor N1. The input terminal IN of the class-D driver 11 receives a control signal from the controller 10 and the output terminal OUT of the class-D driver 11 generates and transmits a high-frequency signal to the low-pass filter 12.

Figure 3:
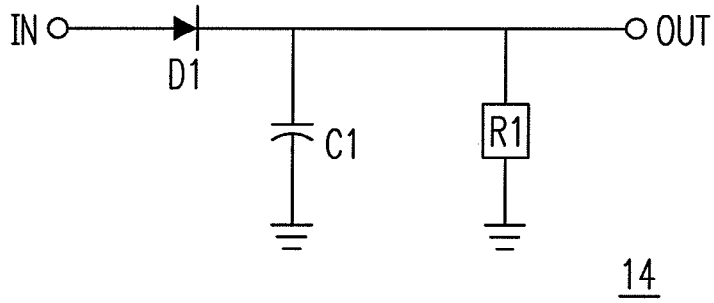
FIG. 3 is a circuit diagram showing the first peak detector of FIG. 1 according to the present invention.

Please refer to FIG. 3, which is a circuit diagram showing the first peak detector of FIG. 1 according to the present invention. The first peak detector 14 is constituted by a diode D1, a capacitor C1 and a resistor R1. The input terminal IN of the first peak detector 14 receives a sine wave signal and the output terminal OUT of the first peak detector 14 transmits the peaks of the detected sine wave signal to the first comparator 15 and the second comparator 16 for being compared.

Figure 4:
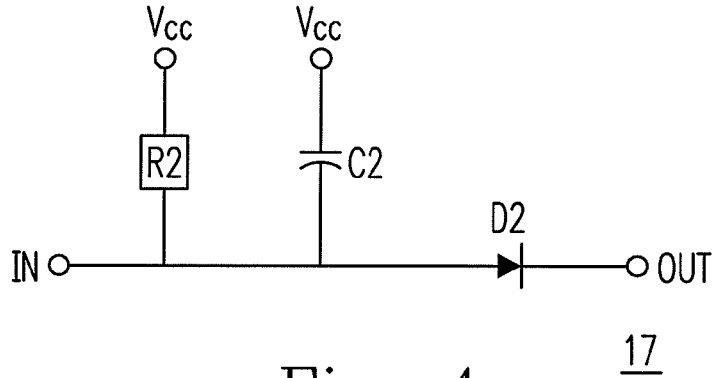
FIG. 4 is a circuit diagram showing the second peak detector of FIG. 1 according to the present invention.
Figure 5A:
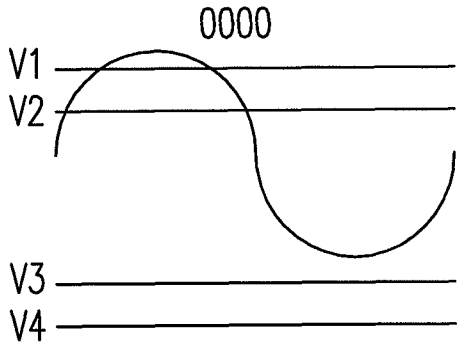
FIGS. 5(*a*)-(*i*) are illustrative diagrams showing the relationships of the sine wave signal and four limits of the peaks.
Figure 5B:
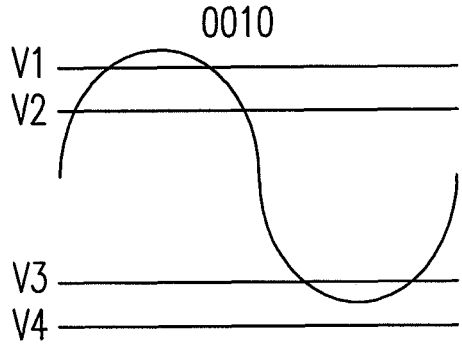
Figure 5C:
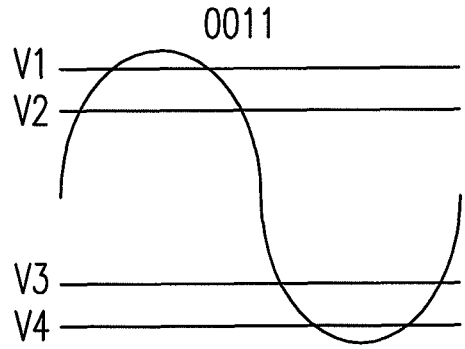
Figure 5D:
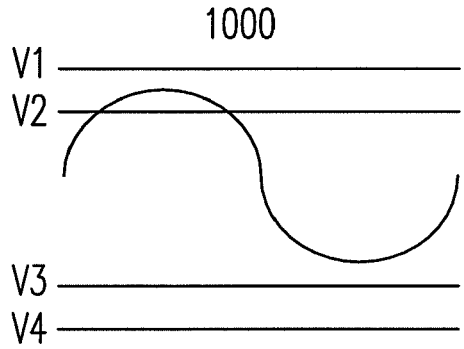
Figure 5E:
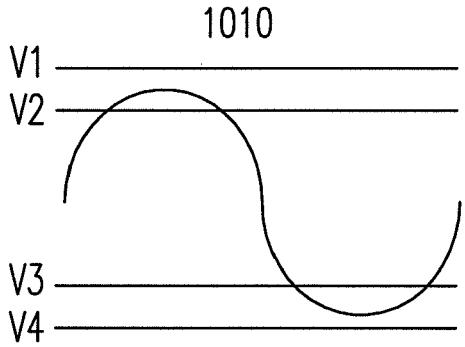
Figure 5F:
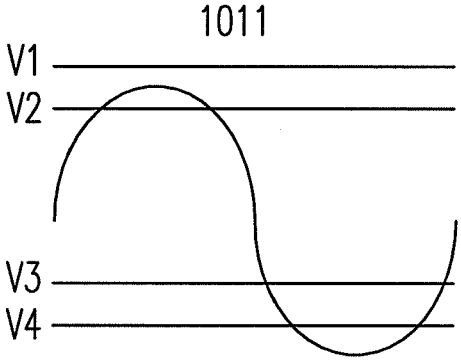
Figure 5G:
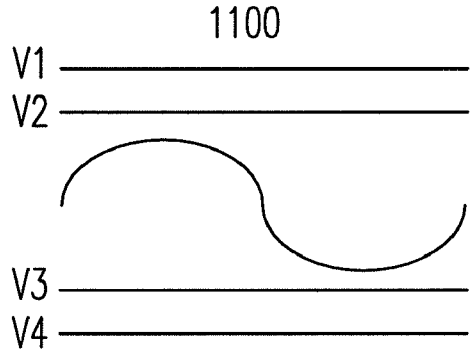
Figure 5H:
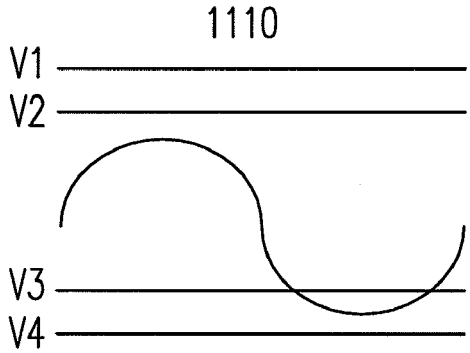
Figure 5I:
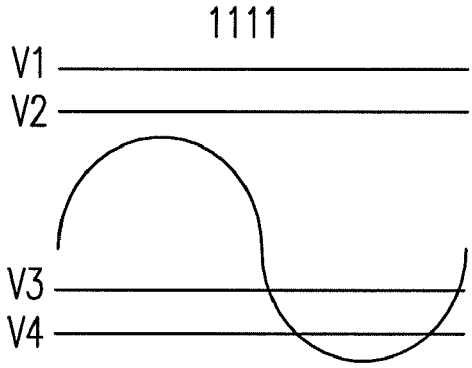

Please refer to FIG. 4, which is a circuit diagram showing the second peak detector of FIG. 1 according to the present invention. The second peak detector 17 is constituted by a diode D2, a capacitor C2 and a resistor R2. The input terminal IN of the second peak detector 17 receives a sine wave signal and the output terminal OUT of the second peak detector 17 transmits the peaks of the detected sine wave signal to the third comparator 18 and the fourth comparator 19 for being compared.

The corresponding adjusting methods of all combinations of the four feedback signal are described as follows. The comparing outcomes of the first, second, third and fourth comparators are expressed in a four-bit number combination as "XXXX", wherein "1" represents a-peak smaller than the limit and "0" represents a peak bigger than the limit.

(a) the feedback signal is "0000"

The "0000" feedback signal means that the maximum peak is bigger than the upper limit V1 and the lower limit V2 and the minimum peak is bigger than the upper limit V3 and the lower limit V4. Accordingly, the sine wave signal is upward shifted. To adjust the sine wave signal, the offset must be decreased, as shown in FIG. 5(*a*).

(b) the feedback signal is "0010"

The "0010" feedback signal means that the maximum peak is bigger than the upper limit V1 and the lower limit V2 and the minimum peak is smaller than the upper limit V3 but bigger than the lower limit V4. Accordingly, the sine wave signal is upward shifted or expanded. To adjust the sine wave signal, the offset must be decreased or the amplitude must be shrunk, as shown in FIG. 5(*b*).

(c) the feedback signal is "0011"

The "0011" feedback signal means that the maximum peak is bigger than the upper limit V1 and the lower limit V2 and the minimum peak is smaller than the upper limit V3 and the lower limit V4. Accordingly, the sine wave signal is expanded. To adjust the sine wave signal, the amplitude must be shrunk, as shown in FIG. 5(*c*).

(d) the feedback signal is "1000"

The "1000" feedback signal means that the maximum peak is smaller than the upper limit V1 but bigger than the lower limit V2 and the minimum peak is bigger than the upper limit V3 and the lower limit V4. Accordingly, the sine wave signal is upward shifted or shrunk. To adjust the sine wave signal, the offset must be decreased or the amplitude must be expanded, as shown in FIG. 5(*d*).

(e) the feedback signal is "1010"

The "1010" feedback signal means that the maximum peak is smaller than the upper limit V1 but bigger than the lower limit V2 and the minimum peak is smaller than the upper limit V3 but bigger than the lower limit V4. Accordingly, the sine wave signal is in the predetermined range. There is no need to adjust the sine wave signal, as shown in FIG. 5(*e*).

(f) the feedback signal is "1011"

The "1011" feedback signal means that the maximum peak is smaller than the upper limit V1 but bigger than the lower limit V2 and the minimum peak is smaller than the upper limit V3 and the lower limit V4. Accordingly, the sine wave signal is downward shifted or expanded. To adjust the sine wave signal, the offset must be increased or the amplitude must be shrunk, as shown in FIG. 5(*f*).

(g) the feedback signal is "1100"

The "1100" feedback signal means that the maximum peak is smaller than the upper limit V1 and the lower limit V2 and the minimum peak is bigger than the upper limit V3 and the lower limit V4. Accordingly, the sine wave signal is shrunk. To adjust the sine wave signal, the amplitude must be expanded, as shown in FIG. 5(*g*).

(h) the feedback signal is "1110"

The "1110" feedback signal means that the maximum peak is smaller than the upper limit V1 and the lower limit V2 and the minimum peak is smaller than the upper limit V3 but bigger than the lower limit V4. Accordingly, the sine wave signal is downward shifted or shrunk. To adjust the sine wave signal, the offset must be increased or the amplitude must be expanded, as shown in FIG. 5(*h*).

(i) the feedback signal is "1111"

The "1111" feedback signal means that the maximum peak is smaller than the upper limit V1 and the lower limit V2 and the minimum peak is smaller than the upper limit V3 and the lower limit V4. Accordingly, the sine wave signal is downward shifted. To adjust the sine wave signal, the offset must be increased, as shown in FIG. 5(*i*).

In the above situations (a)~(i), the controller 10 is a PWM controller. Therefore, the expand or shrink operation is implemented by increasing or decreasing the duty cycle. For those skilled in the art, it is achievable to infer that the expand or shrink operation can be implemented by increasing or decreasing the feaquency of the control signal when the controller 10 is a PFM controller.

Under the situation of the sine wave signals being bigger than ground level and the voltage value of the minimum peak being around the ground level, the second peak detector 17, the third comparator 18 and the fourth comparator 19 can be omitted. The maximum peak will be detected only through the first peak detector 14, the first comparator 15 and the second comparator 16.

In conclusion, the feedback control function of the AC power feedback control device provided in the present invention is achieved with four comparators. The four comparators generates four feedback signals to be processed to stabilize the output voltage. The AC power feedback control device provided in the present invention has at least the following advantages:

(1) the feedback circuit is simple and easily achievable and has low cost;

(2) the easy setting procedures for the amplitude and phase of the waveform is suitable for panels with VFD;

(3) the control device can be applied in the situation of an unstable power supply, e.g vehicles; and (4) the control device can correct the waveform if the load varies.

While the invention has been described in terms of what is presently considered to be the most practical and preferred embodiments, it is to be understood that the invention needs not be limited to the disclosed embodiments. On the contrary, it is intended to cover various modifications and similar arrangements included within the spirit and scope of the appended claims which are to be accorded with the broadest interpretation so as to encompass all such modifications and similar structures.

What is claimed is:

1. An AC power feedback control device, comprising:

a controller generating a control signal;

a first driver receiving the control signal to generate a first high-frequency driving signal;

a first filter filtering the first high-frequency driving signal to generate a first sine wave signal with a maximum peak and a minimum peak;

a filament driven by the first sine wave signal;

a second driver receiving the control signal to generate a second high-frequency driving signal;

a second filter filtering the second high-frequency driving signal to generate a second sine wave signal with a maximum peak and a minimum peak;

a first peak detector detecting a value of the maximum peak of each the sine wave signals;

a first and a second comparators comparing the values of the maximum peaks with a first and a second predetermined voltage values respectively so as to modulate the control signal;

a second peak detector detecting a value of the minimum peak of each the sine wave signals; and a third and a fourth comparators comparing the values of the minimum peaks with a third and a fourth predetermined voltage values respectively so as to modulate the control signal.

2. The AC power feedback control device as claimed in claim 1, wherein the controller is one of a PWM controller and a PFM controller.

3. The AC power feedback control device as claimed in claim 1, wherein each of the drivers comprises a class-D driver.

4. The ac power feedback control device as claimed in claim 1, wherein each of the filters comprises a low-pass filter.

5. The ac power feedback control device as claimed in claim 1, wherein the filament is for lighting a vacuum fluorescent display.

6. An ac power feedback control device, comprising:

a controller generating a control signal;

a first filtering apparatus filtering the control signal to generate a first sine wave signal with a maximum peak;

a filament driven by the first sine wave signal;

a second filtering apparatus filtering the control signal to generate a second sine wave signal with a maximum peak;

a first peak detector detecting a value of the maximum peak of each the sine wave signals; and a first comparator and a second comparator comparing the values of the maximum peaks with a first and a second predetermined voltage values respectively so as to modulate the control signal.

7. The AC power feedback control device as claimed in claim 6, wherein the controller is one of a PWM controller and a PFM controller.

8. The AC power feedback control device as claimed in claim 6, wherein each of the filtering apparatuses comprises at least a class-D driver and at least a low-pass filter.

9. The AC power feedback control device as claimed in claim 6, wherein the filament is for lighting a vacuum fluorescent display.

10. The AC power feedback control device as claimed in claim 6, further comprising:

a second peak detector detecting a value of a minimum peak of each the sine wave signals; and a third comparator and a fourth comparator comparing the values of the minimum peaks with a third and a fourth predetermined voltage values respectively so as to modulate the control signal.

11. The AC power feedback control device as claimed in claim 6, wherein the second peak is a minimum peak of the sine wave signal.

12. An AC power feedback control device, comprising:

a controller generating a control signal;

a filtering apparatus filtering the control signal to generate a sine wave signal with a first peak;

a filament driven by the sine wave signal;

a first peak detector detecting a value of the first peak of the sine wave signal; and a first comparator and a second comparator comparing the value of the first peak with a first and a second predetermined voltage values respectively so as to modulate the control signal.

13. The AC power feedback control device as claimed in claim 12, wherein the controller is one of a PWM controller and a PFM controller.

14. The AC power feedback control device as claimed in claim 12, wherein the filtering apparatus comprises at least a class-D driver and at least a low-pass filter.

15. The AC power feedback control device as claimed in claim 12, wherein the filament is for lighting a vacuum fluorescent display.

16. The AC power feedback control device as claimed in claim 12, wherein the first peak is a maximum peak of the sine wave signal.

17. The AC power feedback control device as claimed in claim 12, further comprising:

a second peak detector detecting a value of a second peak of the sine wave signal; and a third comparator and a fourth comparator comparing the value of the second peak with a third and a fourth predetermined voltage values respectively so as to modulate the control signal.

* * * * *